US007116322B2

(12) United States Patent
Ko et al.

(10) Patent No.: US 7,116,322 B2
(45) Date of Patent: Oct. 3, 2006

(54) DISPLAY APPARATUS AND CONTROLLING METHOD THEREOF

(75) Inventors: Kyung-Pill Ko, Suwon (KR); Hyun-Joon Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 455 days.

(21) Appl. No.: 10/162,085

(22) Filed: Jun. 5, 2002

(65) Prior Publication Data

US 2003/0043140 A1 Mar. 6, 2003

(30) Foreign Application Priority Data

Aug. 29, 2001 (KR) ..... 2001-52455

(51) Int. Cl.
*G09G 5/00* (2006.01)

(52) U.S. Cl. ..... 345/211

(58) Field of Classification Search ..... 345/211–215, 345/87, 88; 348/730; 713/310, 300, 320, 713/323, 340, 322, 501
See application file for complete search history.

(56) References Cited

U.S. PATENT DOCUMENTS

| | | | | |
|---|---|---|---|---|
| 5,619,707 | A * | 4/1997 | Suboh | 713/322 |
| 5,675,364 | A * | 10/1997 | Stedman et al. | 345/211 |
| 5,949,437 | A * | 9/1999 | Clark | 345/502 |
| 6,016,071 | A | 1/2000 | Shay | 327/296 |
| 6,021,501 | A | 2/2000 | Shay | 713/322 |
| 6,052,792 | A | 4/2000 | Mensch, Jr. | 713/322 |
| 6,115,032 | A | 9/2000 | Kotha et al. | 345/211 |
| 6,545,688 | B1 * | 4/2003 | Loveridge et al. | 345/660 |
| 6,563,484 | B1 * | 5/2003 | Song | 345/98 |
| 6,577,303 | B1 * | 6/2003 | Kim | 345/212 |
| 6,587,101 | B1 * | 7/2003 | Yoo | 345/211 |
| 6,597,370 | B1 * | 7/2003 | Lee | 345/660 |
| 6,606,088 | B1 * | 8/2003 | Yang et al. | 345/211 |
| 6,678,834 | B1 * | 1/2004 | Aihara et al. | 713/501 |
| 2002/0060676 | A1 * | 5/2002 | Kim | 345/212 |
| 2002/0075253 | A1 * | 6/2002 | Park et al. | 345/211 |
| 2002/0191108 | A1 * | 12/2002 | Ko | 348/569 |

FOREIGN PATENT DOCUMENTS

| | | |
|---|---|---|
| JP | 2000-298536 | 10/2000 |
| JP | 2000-347640 | 12/2000 |
| KR | 2000-65497 | 11/2000 |

* cited by examiner

*Primary Examiner*—Richard Hjerpe
*Assistant Examiner*—Kevin M. Nguyen
(74) *Attorney, Agent, or Firm*—Robert E. Bushnell, Esq.

(57) ABSTRACT

A display apparatus comprises input parts through which analog and digital video signals outputted from a video card are inputted, and a plurality of driving components. The apparatus further comprises: an electric power supply part for supplying electric power; a scaler chip including an A/D converter and PLL and a TMDS part for processing an analog video signal and a digital video signal, respectively; and a controller for detecting horizontal and vertical synchronous signals decoded by the TMDS part of the scaler chip, and for lowering the number of driving clocks of the scaler chip and turning off the driving components according to determination of a power saving mode when at least one of the horizontal and vertical synchronous signals is not outputted. With this configuration, electric power consumption is effectively minimized in a power saving mode in a display apparatus having a unified scaler chip.

17 Claims, 4 Drawing Sheets

DISPLAY APPARATUS AND CONTROLLING METHOD THEREOF

CLAIM OF PRIORITY

This application makes reference to, incorporates the same herein, and claims all benefits accruing under 35 U.S.C. §119 from my application DISPLAY APPARATUS AND CONTROLLING METHOD THEREOF filed with the Korean Industrial Property Office on 29 Aug. 2001 and there duly assigned Serial No. 52455/2001.

BACKGROUND OF THE INVENTION

1. Technical Field

The present invention relates, in general, to a display apparatus and controlling method thereof and, more particularly, to a display apparatus and controlling method thereof in which electric power consumption can be effectively minimized in a power saving mode by controlling a unified scaler chip.

2. Description of the Related Art

A computer system comprises a computer having a storage unit, such as a hard disk drive, a memory, a main board on which a video card is mounted, and a power supply unit supplying electric power to the storage unit and to the main board. A display apparatus is connected to the computer and receives a video signal from the video card of the computer so as to display a picture thereon.

To minimize electric power consumption in the computer system, a display power management system (DPMS) and method have been employed to suspend operations of chips in connection with video signal processing in the display apparatus when data is not inputted from the video card for a predetermined period of time.

In the display apparatus, the DPMS and related method include three modes according to the input of horizontal (H) and vertical (V) synchronous signals generated by the video card. The three modes are a standby mode in which the H synchronous signal is not inputted, a suspending mode in which the V synchronous signal is not inputted, and a complete power saving mode in which both the H and V synchronous signals are not inputted.

The display apparatus comprises a D-sub connector port through which analog red/green/blue (R/G/B) video signals and H/V synchronous signals are received from the video card of the computer, an analog/digital (A/D) converter for converting the analog R/G/B video signals from the D-sub connector port into digital signals, a liquid crystal display (LCD) panel for displaying a picture thereon, and a panel driver driving the LCD panel. The display apparatus further comprises a digital video interface (DVI) connector port through which digital video signals are received, a transition minimized differential signaling (TMDS) part for decoding compressed digital video signals from the DVI connector port into R/G/B video signals and H/V synchronous signals, and a scaler for processing the synchronous signals and the digital R/G/B video signals received from the A/D converter and the TMDS part according to the size of the LCD panel, and for outputting them to an LCD panel driver.

Thus, in the display apparatus, the three modes of the DPMS method are determined according to synchronous signals received from the D-sub connector port and the TMDS part in order to suspend operation of each component, thereby minimizing electric power consumption.

Recently, a unified scaler chip having the functions of the A/D converter, the TMDS part and the scaler of the display apparatus has been developed. However, in the display apparatus having the unified scaler chip, the type of synchronous signal is directly determined by the D-sub connector port in the case of the input of analog H/V synchronous signals, but it is indirectly determined by the unified scaler chip in the case of the input of digital video signals. Thus, electric power must be always supplied to the unified scaler chip, and this makes it difficult to meet the DPMS standard.

The following are considered to be generally pertinent to the present invention but are burdened by the disadvantages set forth above: U.S. Pat. No. 6,016,071 to Shay, entitled INTERNAL SOURCE CLOCK GENERATION CIRCUIT FOR USE WITH POWER MANAGEMENT, issued on Jan. 18, 2000; U.S. Pat. No. 6,021,501 to Shay, entitled CLOCK ENABLE/DISABLE CIRCUIT OF POWER MANAGEMENT SYSTEM, issued on Feb. 1, 2000; U.S. Pat. No. 6,052,792 to Mensch Jr., entitled POWER MANAGEMENT AND PROGRAM EXECUTION LOCATION MANAGEMENT SYSTEM FOR CMOS MICROCOMPUTER, issued on Apr. 18, 2000; U.S. Pat. No. 6,115,032 to Kotha et al., entitled CRT TO FPD CONVERSION PROTECTION APPARATUS AND METHOD, issued on Sep. 5, 2000; Korean Patent Publication No. 2000-65497 to Joon-Hee Kim et al., entitled A CIRCUIT FOR OPERATING LCD MONITOR, published on 15, Nov. 2000; Japanese Patent Publication No. 2000-298536 to Fujimoto, entitled INFORMATION PROCESSOR, published on Oct. 24, 2000; and Japanese Patent Publication No. 2000-347640 to Yamada, entitled ELECTRONIC DEVICE, DISPLAY SYSTEM, AND METHOD THEREOF, published on Dec. 15, 2000.

SUMMARY OF THE INVENTION

The present invention has been developed with the above-described shortcomings and the needs of the user in mind. Thus, an object of the present invention is to provide a display apparatus having a unified scaler chip and controlling method thereof in which electric power consumption can be effectively minimized in a power saving mode.

This and other objects of the present invention are accomplished by the provision of a display apparatus comprising input parts, through which respective analog and digital video signals outputted from a video card are inputted, and a plurality of driving components. The display apparatus further comprises: an electric power supply part for supplying electric power; a scaler chip, including an A/D converter and a TMDS part, for processing an analog video signal and a digital video signal, respectively; and a controller for detecting horizontal and vertical synchronous signals of the digital video signal decoded by the TMDS part of the scaler chip, for turning off the driving components according to determination of a power saving mode when at least one of the horizontal and vertical synchronous signals is not outputted or detected, and for lowering the number of driving clocks of the scaler chip.

Preferably, the controller includes a memory, and sets a power saving mode flag in the memory when at least one of the horizontal and vertical synchronous signal is not detected.

As a further preference, the scaler chip includes a plurality of registers, and the controller sets one of those registers related to clock setting so as to lower the number of driving clocks of the scaler chip when the power saving mode flag is set.

Further, the controller removes or resets the power saving mode flag when both the horizontal and vertical synchronous signals are inputted, and resets the register related to clock setting so as to restore the number of driving clocks of the scaler chip.

Furthermore, the controller checks the analog video signal input part, and establishes the power saving mode when at least one of the horizontal and vertical synchronous signals is not detected so as to turn off the A/D converter and the TMDS part.

According to another aspect of the present invention, the above and other objects may also be achieved by the provision of a method of controlling a display apparatus comprising a scaler chip for processing analog and digital video signals outputted from a video card and a plurality of driving components. The method comprises the steps of: detecting whether a video signal from the video card is an analog signal or a digital signal; detecting whether horizontal and vertical synchronous signals are outputted when the video signal is the digital signal; and, when at least one of the horizontal and vertical synchronous signals is not detected, establishing a power saving mode, lowering the number of driving clocks of the scaler chip, and turning off the driving components.

The method further comprises the step of setting a power saving mode flag when at least one of the horizontal and vertical synchronous signals is not detected.

Furthermore, the method comprises the step of periodically checking the scaler chip so as to reset or remove the power saving mode flag when both the horizontal and vertical synchronous signals are detected, and so as to restore the number of the driving clocks of the scaler chip.

On the other hand, the method further comprises the step of turning off the A/D converter, the TMDS part, the unified scaler chip and the driving components in accordance with the determination of a power saving mode when at least one of the horizontal and vertical synchronous signals of the analog video signal is not outputted.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

The present invention will be described in more detail with reference to the accompanying drawings.

Figure 1:
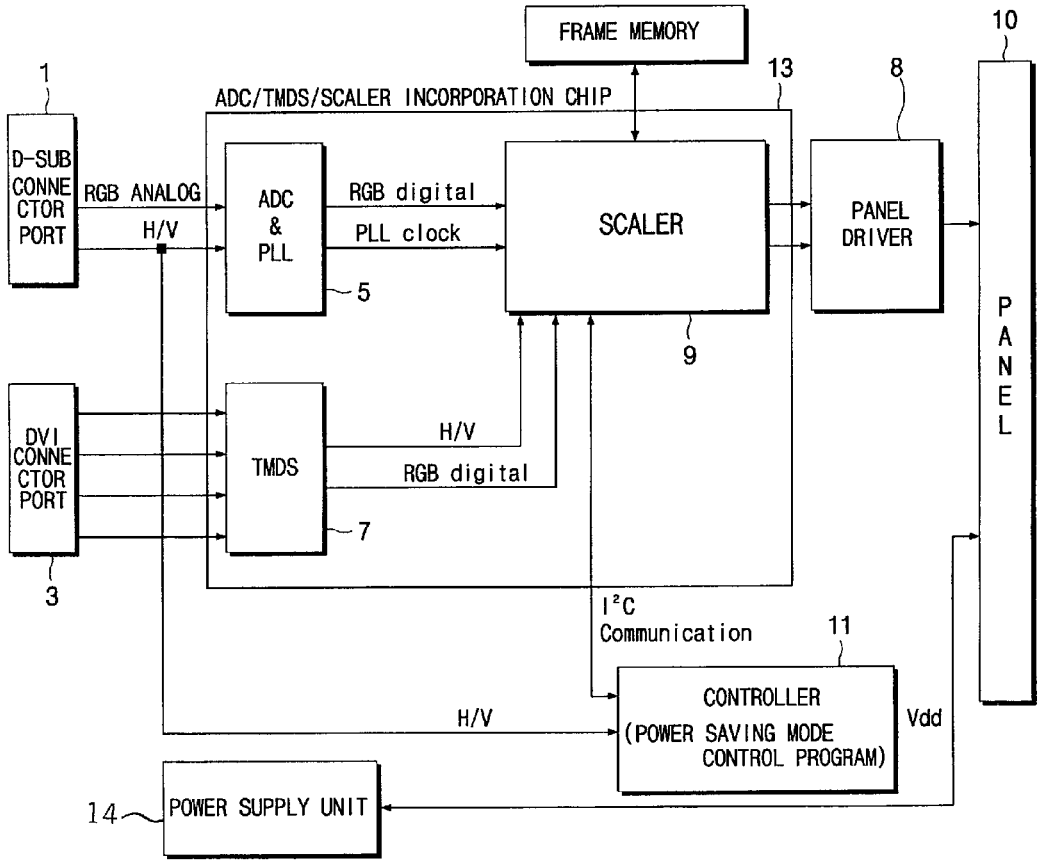
FIG. 1 is a control block diagram of a display apparatus according to the present invention.

FIG. 1 is a control block diagram of a display apparatus according to the present invention. As shown in FIG. 1, a display apparatus comprises a D-sub connector port 1 employed as an input interface through which analog R/G/B video signals and H/V synchronous signals from the video card (not shown) of a computer are received, a DVI (digital video interface) connector port 3 through which digital video signals from the video card (not shown) are received, a panel driver 8 for driving an LCD panel 10 which displays a picture thereon, a unified scaler chip 13 for processing the video signals received from the D-sub connector port 1 and the DVI connector port 3, a controller 11 for receiving the H/V synchronous signals from the D-sub connector port 1 or the unified scaler chip 13, and for determining a resolution and dot clocks corresponding to frequencies of the received signals, and a power supply unit 14 for providing power to the LCD panel 10.

The unified scaler chip 13 includes a first circuit part (transition minimized differential signaling or TMDS part 7) for decoding compressed video signals into digital R/G/B video signals and H/V synchronous signals, a second circuit part (scaler 9) for processing the synchronous signals from TMDS part 7 and digital R/G/B signals, and a third circuit part (A/D converter and phase-locked loop (PLL) 5) for converting the analog R/G/B video signals from the D-sub-connector port 1 into digital signals for processing by the second circuit part (scaler 9). The second circuit part (scaler 9) processes the synchronous signals from TMDS part 7 and the digital R/G/B signal from A/D converter and PLL 5 according to the size of the LCD panel 10, and outputs them to the panel driver 8. That is, the scaler 9 receives the digital R/G/B video signals from the A/D converter 5 together with the digital R/G/B video signals and H/V synchronous signals from the TMDS part 7, and processes them. It should be noted that the A/D converter part and PLL 5, preferably, comprises an analog-to-digital converter (ADC) and a phase-locked loop (PLL) for providing RGB digital signals and PLL clock signals, respectively, to the scaler 9.

In the unified scaler chip 13, the A/D converter and PLL 5, the TMDS part 7, and the scaler 9 may be divided into separate blocks as shown in FIG. 1, or they may be formed into one circuit by the manufacturer. Preferably, the unified scaler chip 13 is provided with a plurality of external communication pins for communication between the internal components of scaler chip 13 and the controller 11. Thus, the controller 11 detects which of the A/D converter 5 and the TMDS part 7 outputs the digital R/G/B video signals and the H/V synchronous or PLL clock signals through the plurality of communication pins.

Furthermore, the unified scaler chip 13 includes a register related to the synchronous signal for determining whether the H/V synchronous signals are outputted from the TMDS part 7, and a register for turning on/off the A/D converter and PLL 5, the TMDS part 7 and the scaler 9. The unified scaler chip 13 also includes a communication pin for $I^2C$ communication between the internal components and the controller 11. The controller 11 transmits a control signal to the unified scaler chip 13 through the $I^2C$ communication pin in order to set up the registers.

According to the present invention, a power saving mode control program is stored in controller 11. The program is designed to establish a power saving mode when at least one of the H/V synchronous signals is not outputted from the TMDS part 7 of the unified scaler chip 13, to set a power saving flag inside a memory (not shown) of the controller 11 according to the power saving mode determination, and to lower the number of driving clocks of the unified scaler chip 13 according to the set power saving flag.

The power saving mode control program of the controller 11 allows a control signal to be transmitted to the unified scaler chip 13 so as to switch on/off the A/D converter and PLL 5 and the TMDS part 7 of the unified scaler chip 13. Thus, the power saving mode control program periodically polling-checks the synchronous signal register to determine whether the H/V synchronous signals are outputted from the TMDS part 7 of the unified scaler chip 13, and sets a register related to the driving clocks to a low value so as to lower the number of driving clocks of the unified scaler chip 13 when at least one of the H/V synchronous signals is not outputted by TMDS part 7.

Further, the power saving mode control program periodically checks to determine whether H/V synchronous signals of analog video signals are inputted through the D-sub connector port 1, and sets a power saving flag in the memory when at least one of the H/V synchronous signals is not received, thereby establishing a power saving mode. Then, on the basis of the set power saving flag, the power saving mode control program turns off the unified scaler chip 13 and driving components, such as panel driver 8, so as to begin the power saving mode.

Figure 2:
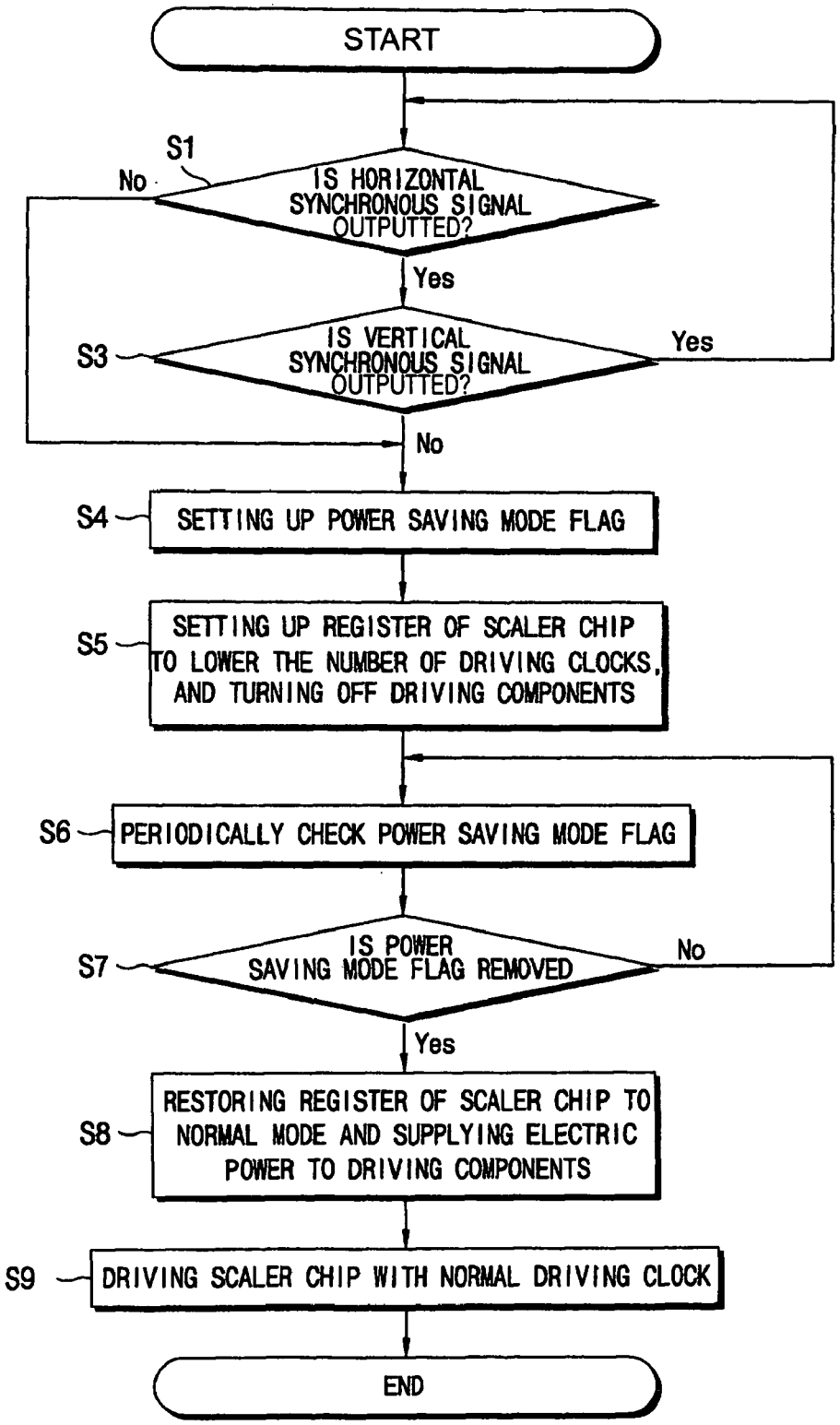
FIG. 2 is a control flow chart illustrating the state in which a digital video signal is inputted to the display apparatus.

FIG. 2 is a control flow chart illustrating the state in which a digital video signal is inputted to the display apparatus. As shown in FIG. 2, when a digital video signal is inputted from a video card, the power saving mode control program of the controller 11 poll-checks the register related to the synchronous signals of the unified scaler chip 13 to determine whether the H/V synchronous signals are outputted from the TMDS part 7 through the $I^2C$ communication pin of the unified scaler chip 13 (S1 and S3). When the TMDS part 7 outputs only the H synchronous signal, only the V synchronous signal, or neither of the H and V synchronous signals (steps S1 and S3), the power saving mode control program sets the power saving mode flag inside the memory (S4), and then sets the register related to the driving clocks so as to lower the number of driving clocks of the unified scaler chip 13 on the basis of the power saving mode flag, sets the register related to the A/D converter and PLL 5 and the scaler 9 so as to suspend the operations of the A/D converter and PLL 5 and the scaler 9, and switches off the driving components, such as the panel driver 8, etc. (S5). Thereafter, the power saving mode control program periodically checks the power saving mode flag which is set according to whether the H/V synchronous signals are outputted from the unified scaler chip 13 (S6), and detects whether the power saving mode flag is removed or reset (S7). When the power saving mode flag is removed or reset (i.e., when the power saving mode is changed into a normal power mode after both the H and V synchronous signals are inputted), the power saving mode control program resets or restores the register related to the A/D converter and PLL 5 and the scaler 9 so as to restore the number of driving clocks of the unified scaler chip 13, thereby supplying normal electric power to the driving components (58). When normal electric power is supplied, the unified scaler chip 13 is operated with a normal number of driving clocks (S9).

Figure 3:
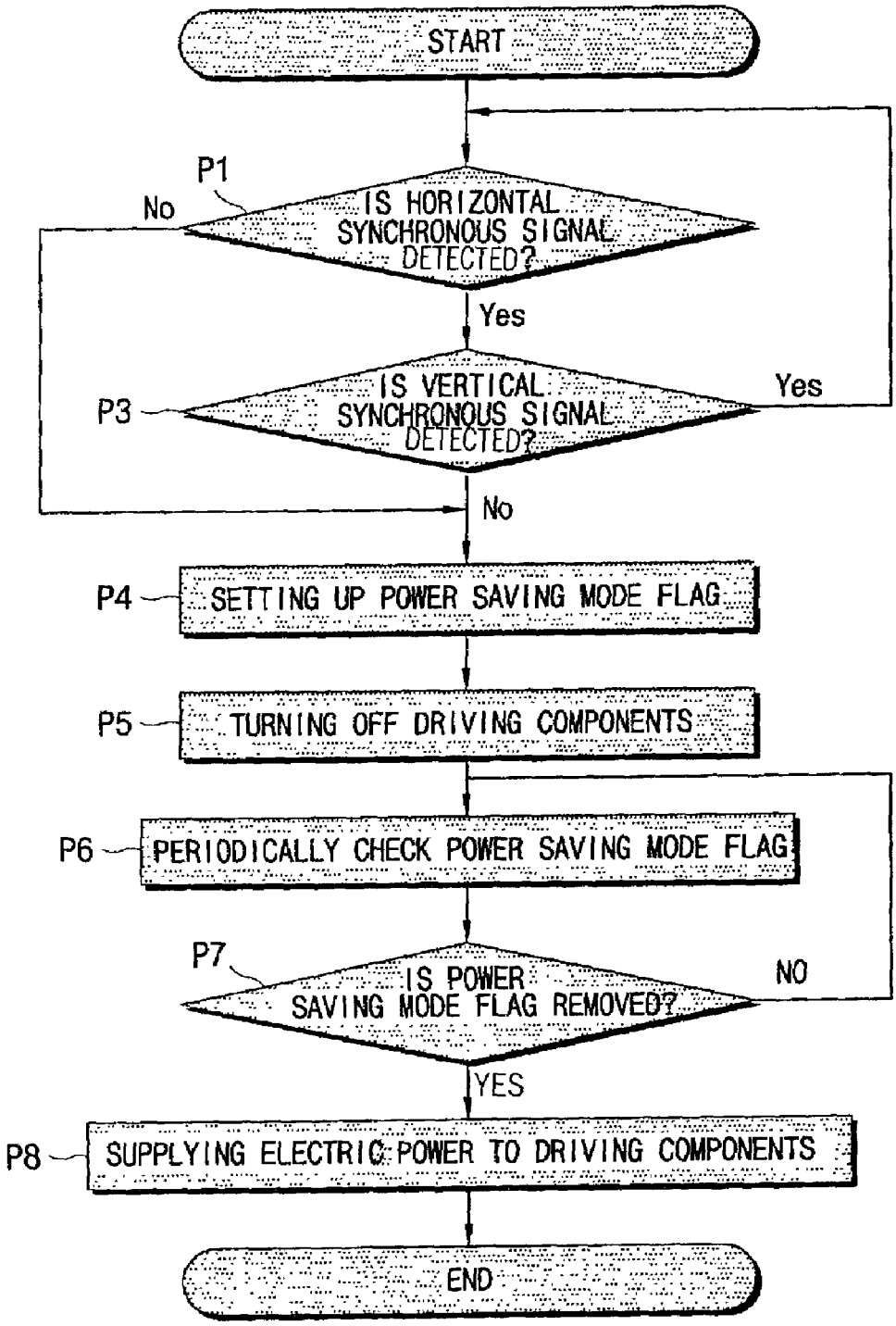
FIG. 3 is a control flow chart illustrating the state in which an analog video signal is inputted to the display apparatus.

FIG. 3 is a control flow chart illustrating the state in which an analog video signal is inputted to the display apparatus. As shown in FIG. 3, when an analog video signal is inputted from the video card, the power saving mode control program of the controller 11 periodically checks to determine whether the H/V synchronous signals are transmitted from the D-sub connector port 1 to the unified scaler chip 13 (P1 and P3). When both the H and the V synchronous signals are not inputted from the video card, the power saving mode control program sets the power saving mode flag inside the memory (P4), and sets the register related to the unified scaler chip 13 so as to suspend the operation of the unified scaler chip 13 and switch off the driving components on the basis of the power saving mode flag (P5). Thereafter, the power saving mode control program periodically checks the power saving mode flag (P6) to determine whether or not the power saving mode flag is removed or reset (P7). The power saving mode control program continues to periodically check the power saving mode flag until the power saving mode flag is removed or reset. Once the power saving mode flag is removed or reset, the power saving mode control program allows electric power to be supplied to the unified scaler chip 13 and the driving components (P8).

In the latter description, the controller 11 establishes the power saving mode whenever the H or V synchronous signal is not inputted to the scaler chip 13, and whenever both synchronous signals are not inputted.

As described above, using the unified scaler chip 13 having the TMDS part 7 for decoding the compressed digital video signals to output the H/V synchronous signals and the A/D converter and PLL 5 for digitizing the analog video signals, the number of driving clocks of the unified scaler chip 13 is lowered in the power saving mode, thereby increasing power saving efficiency and decreasing heat generated by the unified scaler chip 13.

As described above, the present invention provides a display apparatus and controlling method thereof in which electric power consumption can be effectively minimized by controlling the unified scaler chip 13 in a power saving mode.

Figure 4:
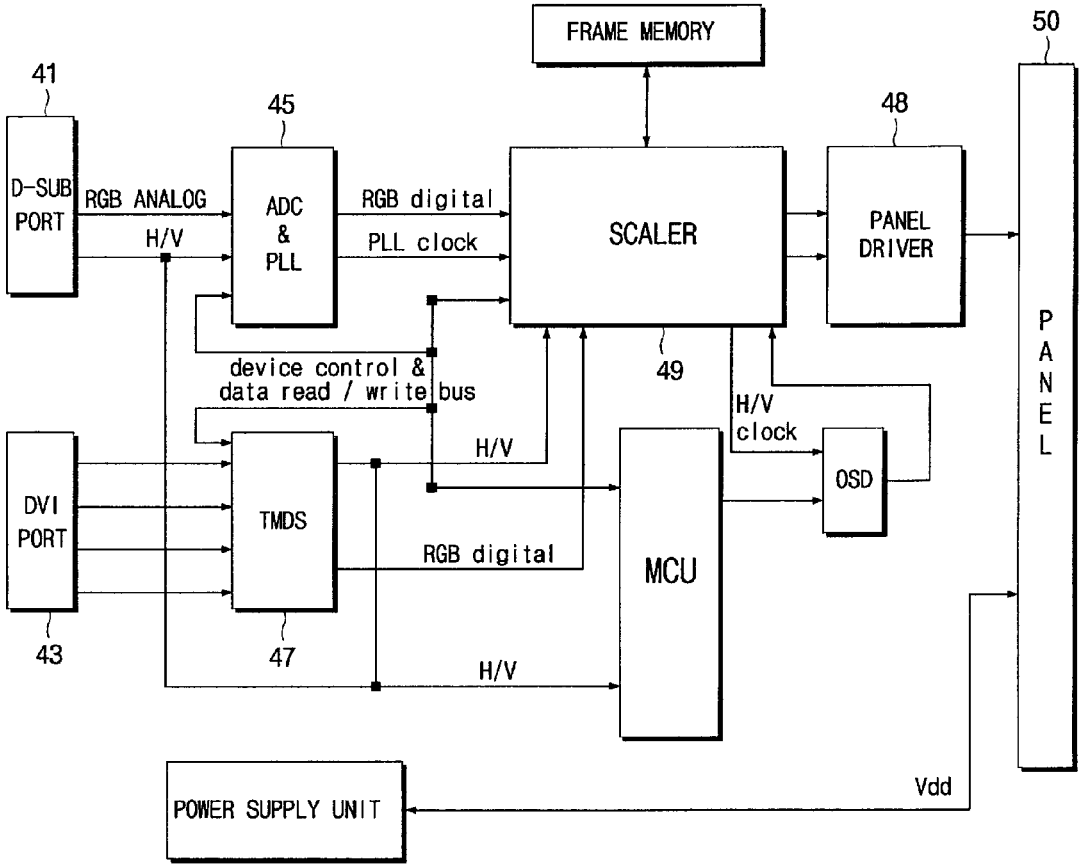
FIG. 4 is a control block diagram of a display apparatus.

FIG. 4 is a control block diagram of a display apparatus. As shown therein, the display apparatus comprises a D-sub connector port 41 through which analog R/G/B video signals and H/V synchronous signals are received from the video card (not shown) of a computer, an A/D converter and PLL 45 for converting the analog R/G/B video signals from the D-sub connector port 41 into digital signals, an LCD panel 50 for displaying a picture thereon, and a panel driver 48 for driving the LCD panel 50. The display apparatus further comprises a DVI connector port 43 through which digital video signals are received, a TMDS part 47 for decoding compressed digital video signals from the DVI connector port 43 into R/G/B video signals and H/V synchronous signals, and a scaler 49 for processing the synchronous signals and the digital R/G/B video signals received from the A/D converter and PLL 45 and the TMDS part 47 according to the size of the LCD panel 50, and for outputting them to the panel driver 48.

Thus, in the display apparatus of FIG. 4, the three modes of the DPMS method are determined according to synchronous signals received from the D-sub connector port 41 and the TMDS part 47 so as to suspend operation of each component, thereby minimizing electric power consumption.

Recently, a unified scaler chip having the functions of the A/D converter and PLL 45, the TMDS part 47 and the scaler 49 of the display apparatus has been developed. However, in the display apparatus having such a unified scaler chip, the type of synchronous signal is directly determined by the D-sub connector port 41 in the case of the input of analog H/V synchronous signals, but it is indirectly determined by the unified scaler chip in the case of the input of digital video signals. Thus, electric power must always be supplied to the unified scaler chip, and this makes it difficult to meet the DPMS standard.

Although the preferred embodiments of the present invention have been described, it will be understood by those skilled in the art that the present invention should not be limited to the described preferred embodiments. Rather, various changes and modifications can be made within the spirit and scope of the present invention, as defined by the following claims.

What is claimed is:

1. A display apparatus, comprising:

input means for receiving analog and digital video signals outputted from a video card;

a plurality of driving components;

an electric power supply part for supplying electric power;

a scaler chip including an analog-to-digital converter and phase-locked loop (ADC&PLL) part for receiving and processing the analog video signals and horizontal and vertical synchronous signals of the analog video signals, and producing first RGB digital signals and a PLL clock signal, a transmission minimized differential signaling (TMDS) part for receiving and processing the digital video signals to produce second RGB digital signals and horizontal and vertical synchronous signals of the digital video signals, and a scaler connected to said ADC&PLL part for receiving and processing the first RGB digital signals and the PLL clock signal, and connected to said TMDS part for receiving and processing the second RGB digital signals and the horizontal and vertical synchronous signals of the digital video signals; and a controller connected to said scaler for detecting the horizontal and vertical synchronous signals of the digital video signals processed by the TMDS part, and for turning off the driving components and lowering a number of driving clocks of the scaler chip according to establishment of a power saving mode when at least one of the horizontal and vertical synchronous signals of the digital video signals is not detected.

2. The display apparatus according to claim 1, wherein the controller includes a memory, and sets a power saving mode flag inside the memory when said at least one of the horizontal and vertical synchronous signals of the digital video signals is not detected.

3. The display apparatus according to claim 2, wherein the scaler chip includes a plurality of registers, and the controller sets a register related to clock setup so as to lower the number of the driving clocks of the scaler chip when the power saving mode flag is set.

4. The display apparatus according to claim 3, wherein the controller resets the power saving mode flag and resets the register related to clock setup so as to restore the number of the driving clocks of the scaler chip when both the horizontal and vertical synchronous signals of the digital video signals are detected.

5. The display apparatus according to claim 1, wherein the controller establishes the power saving mode and turns off the ADC+PLL part and the TMDS part when said at least one of the horizontal and vertical synchronous signals of the digital video signals is not detected.

6. The display apparatus according to claim 1, wherein said controller has an input connected to said input means for receiving the horizontal and vertical synchronous signals of the analog video signals, said controller turning off said scaler chip and the driving components according to the establishment of the power saving mode when at least one of the horizontal and vertical synchronous signals of the analog video signals is not detected.

7. A display apparatus, comprising:

an input interface part for receiving a video signal;

a chip including a first circuit part for receiving a digital video signal from the input interface part and for outputting first RGB digital signals and at least one of horizontal and vertical synchronous signals of the digital video signal, a second circuit part for receiving an analog video signal from the input interface part, for converting the analog video signal into second RGB digital signals, and for outputting the second RGB digital signals and a phase-locked ioop (PLL) clock signal, and a third circuit part connected to said first and second circuit parts for receiving and processing the first and second RGB digital signals, said at least one of the horizontal and vertical synchronous signals of the digital video signal, and the PLL clock signal; and a controller for detecting said at least one of the horizontal and vertical synchronous signals of the digital video signal, for setting a power saving mode when said at least one of the horizontal and vertical synchronous signals of the digital video signal is not detected, and for lowering a clock frequency of the chip when the power saving mode is set when said at least one of the horizontal and vertical synchronous signals of the digital video signal is not detected.

8. The display apparatus according to claim 7, wherein the controller turns off the third circuit part when said at least one of the horizontal and vertical synchronous signals of the digital video signal is not detected.

9. The display apparatus according to claim 7, wherein the chip includes a register for indicating whether a synchronous signal is inputted, and wherein the controller determines whether said at least one of the horizontal and vertical synchronous signals of the digital video signal are inputted by polling-checking the register.

10. The display apparatus according to claim 7, wherein the controller recognizes absence of a synchronous signal through an interrupt signal generated from the chip when said at least one of the horizontal and vertical synchronous signals of the digital video signal is not inputted.

11. The display apparatus according to claim 7, wherein the controller removes a power saving mode flag and restores the clock frequency of the chip to a normal number when both of the horizontal and vertical synchronous signals of the digital video signal are detected.

12. The display apparatus according to claim 7, wherein said controller has an input connected to said input interface part for receiving horizontal and vertical synchronous signals of an analog video signal, said controller turning off said chip and the driving components according to the establishment of the power saving mode when at least one of the horizontal and vertical synchronous signals of the analog video signal is not detected.

13. A display apparatus, comprising:

input means for receiving analog and digital video signals outputted from a video card;

a plurality of driving components;

a scaler chip including a first circuit and a second circuit for processing the analog video signals and the digital video signals, respectively, and a third circuit having inputs connected to respective outputs of said first and second circuits; and a controller connected to said third circuit for detecting horizontal and vertical synchronous signals, and for establishing a power saving mode when at least one of the horizontal and vertical synchronous signals is not detected;

wherein said first circuit receives and processes the analog video signals and horizontal and vertical synchronous signals of the analog video signals to produce a first RGB digital output and a phase-locked loop (PLL) clock signal;

wherein said second circuit receives and processes the digital video signals to produce a second RGB output and horizontal and vertical synchronous signals of the digital video signals;

wherein said third circuit processes the first and second RGB outputs, the PLL clock signal, and the horizontal and vertical synchronous signals of the digital video signals; and said controller turns off the driving components and lowers a number of driving clocks according to establishment of a power saving mode when at least one of the horizontal and vertical synchronous signals of the analog video signals is not detected.

14. The display apparatus according to claim 13, wherein the controller includes a memory, and sets a power saving mode flag inside the memory when said at least one of the horizontal and vertical synchronous signals of the analog video signals is not detected.

15. The display apparatus according to claim 13, wherein the controller disables the power saving mode and resets the register related to clock setup so as to restore the number of the driving clocks when both of the horizontal and vertical synchronous signals of the analog video signals are detected.

16. The display apparatus according to claim 13, wherein the controller turns off the first and second circuits when the power saving mode is established.

17. The display apparatus according to claim 13, wherein said controller has an input connected to said input means for receiving the horizontal and vertical synchronous signals of the analog video signals, said controller turning off said third circuit according to the establishment of the power saving mode when said at least one of the horizontal and vertical synchronous signals of the analog video signals is not detected.

* * * * *